US006642655B2

(12) United States Patent
Matsumoto et al.

(10) Patent No.: US 6,642,655 B2
(45) Date of Patent: Nov. 4, 2003

(54) HIGH-PRESSURE METAL HALIDE DISCHARGE LAMP AND A LIGHTING APPARATUS USING THE LAMP

(75) Inventors: Naoya Matsumoto, Kanagawa-ken (JP); Hiroyuki Ogata, Kanagawa-ken (JP); Shinji Inukai, Kanagawa-ken (JP); Hisanori Sano, Kanagawa-ken (JP); Satoshi Iwasawa, Kanagawa-ken (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 12 days.

(21) Appl. No.: 09/739,624

(22) Filed: Dec. 20, 2000

(65) Prior Publication Data

US 2001/0011872 A1 Aug. 9, 2001

(30) Foreign Application Priority Data

Dec. 20, 1999 (JP) ..... 11-361366

(51) Int. Cl.[7] ..... H05B 41/24; H01J 17/04
(52) U.S. Cl. ..... 313/631; 315/224
(58) Field of Search ..... 315/244, 246; 313/238, 243, 256, 264, 491, 631, 632

(56) References Cited

U.S. PATENT DOCUMENTS 4,024,425 A * 5/1977 Higashi et al. ..... 313/562
5,352,952 A * 10/1994 Juengst ..... 313/623
5,440,196 A * 8/1995 Gleixner ..... 313/25
5,592,049 A * 1/1997 Heider et al. ..... 313/623
5,854,535 A * 12/1998 Hohlfeld et al. ..... 313/112
5,986,405 A * 11/1999 De Maagt et al. ..... 313/25
6,060,829 A * 5/2000 Kubon et al. ..... 313/567
6,121,729 A * 9/2000 Takao et al. ..... 313/558
6,169,365 B1 * 1/2001 Kubon et al. ..... 313/631
6,181,065 B1 * 1/2001 Huettinger et al. ..... 313/567
6,194,832 B1 * 2/2001 Juengst ..... 313/623
6,353,289 B1 * 3/2002 Ishigami et al. ..... 313/568
6,366,020 B1 * 4/2002 Gu et al. ..... 313/613

FOREIGN PATENT DOCUMENTS

JP 5-283039 10/1993

* cited by examiner

*Primary Examiner*—Hoanganh Le
*Assistant Examiner*—Minh D A
(74) *Attorney, Agent, or Firm*—Pillsbury Winthrop LLP

(57) ABSTRACT

A high-pressure metal halide discharge lamp includes a sealed light-transmitting discharge vessel, first and second electrodes disposed in the discharge space, and a pair of conductive wires connected to the respective electrodes. The sealed light-transmitting discharge vessel has a pair of seals and envelops a discharge space, which has a gas filling comprising rare gas and metal halides. A first electrode with an emitter disposed in the discharge space at an one side is made of a metal having a high melting point. A second electrode without an emitter disposed in the discharge space at the other side is made of a metal having a high melting point. The pair of conductive wires, which are connected to the respective electrodes, are located in the respective seals and extend from the discharge vessel.

7 Claims, 3 Drawing Sheets

HIGH-PRESSURE METAL HALIDE DISCHARGE LAMP AND A LIGHTING APPARATUS USING THE LAMP

BACKGROUND OF THE INVENTION

1. Field of the Invention

The present invention relates to a high-pressure metal halide discharge lamp suitable for a light source used in a light fixture or a lighting device.

2. Description of the Related Art

A high-pressure metal halide discharge lamp may be used in any light fixture because of its high luminous efficacy, long life, and good color rendering property. Recently, such a lamp must show high luminous efficacy and long life with a view to saving energy. To increase the luminous efficacy, temperature of a discharge vessel can be raised. The discharge vessel contains an ionizable filling comprising Hg, a rare gas and a metal halide.

Therefore, Hg and the metal halide are able to evaporate quickly. In this case, as the temperature of electrodes in the discharge vessel also becomes higher, the evaporation from the electrodes, which are made of tungsten, increases. This evaporation in the discharge vessel quickly blackens the lamp.

Such a high-pressure metal halide discharge lamp is shown in Japanese Laid Open Patent Application HEI 5-283039. This prior art discloses a technique for preventing quick blackening and improving a lumen maintenance factor of the lamp, by reason of a tip of the electrodes being re-crystallized.

When the conventional lamp having a pair of electrodes is uprightly mounted on a socket, which is provided at an upper side in a light fixture, the temperature of the upper electrode becomes higher than lower electrode. As the evaporation of the electrode at the upper side in the discharge vessel of the lamp increases, it causes the quick blackening. Therefore, the upper and lower electrodes made of doped-tungsten may be useful to obviate the evaporation thereof. Further in this case, the lamp might turn off occasionally. Because the temperature of the lower electrode remains low for the reason of no heat convection in the discharge vessel, thermionic electrons do not appropriately emit from the lower electrode.

SUMMARY OF THE INVENTION

It is an object of the invention to provide a high-pressure metal halide discharge lamp in which blackening and extinguishing are obviated.

According to the invention, a high-pressure metal halide discharge lamp includes a sealed light-transmitting discharge vessel, first and second electrodes disposed in the discharge space and a pair of conductive wires connected to the respective electrodes.

The sealed light-transmitting discharge vessel has a pair of seals and envelops a discharge space, which has a gas filling comprising a rare gas and metal halides. The first electrode, which is disposed in the discharge space at one side, is made of a metal having a high melting point and having an emitter. The second electrode without an emitter is disposed in the discharge space at the other side. The second electrode is also made of a metal having a high melting point. A pair of conductive wires connected to the respective electrodes, are located in the respective seals and extend from the discharge vessel.

In accordance with the present invention, a lighting apparatus includes a high-pressure metal halide discharge lamp as described above, a luminarie housing having a ballast, and a socket connected to the discharge lamp cap.

These and other aspects of the invention will be further described in reference to the following drawings and detailed description of the invention.

BRIEF DESCRIPTION OF THE DRAWINGS

In the following, the invention will be described in more detail by way of examples illustrated by drawings in which.

DETAILED DESCRIPTION OF PREFERRED EMBODIMENTS

Referring now to FIGS. 1 to 5, embodiments of this invention will be explained.

A high-pressure metal halide discharge lamp of this embodiment is uprightly mounted in a socket (not shown), which is provided with a light fixture at an upper side. The rated lamp power is 250 W, and the lamp receives an alternating current power.

Figure 1:
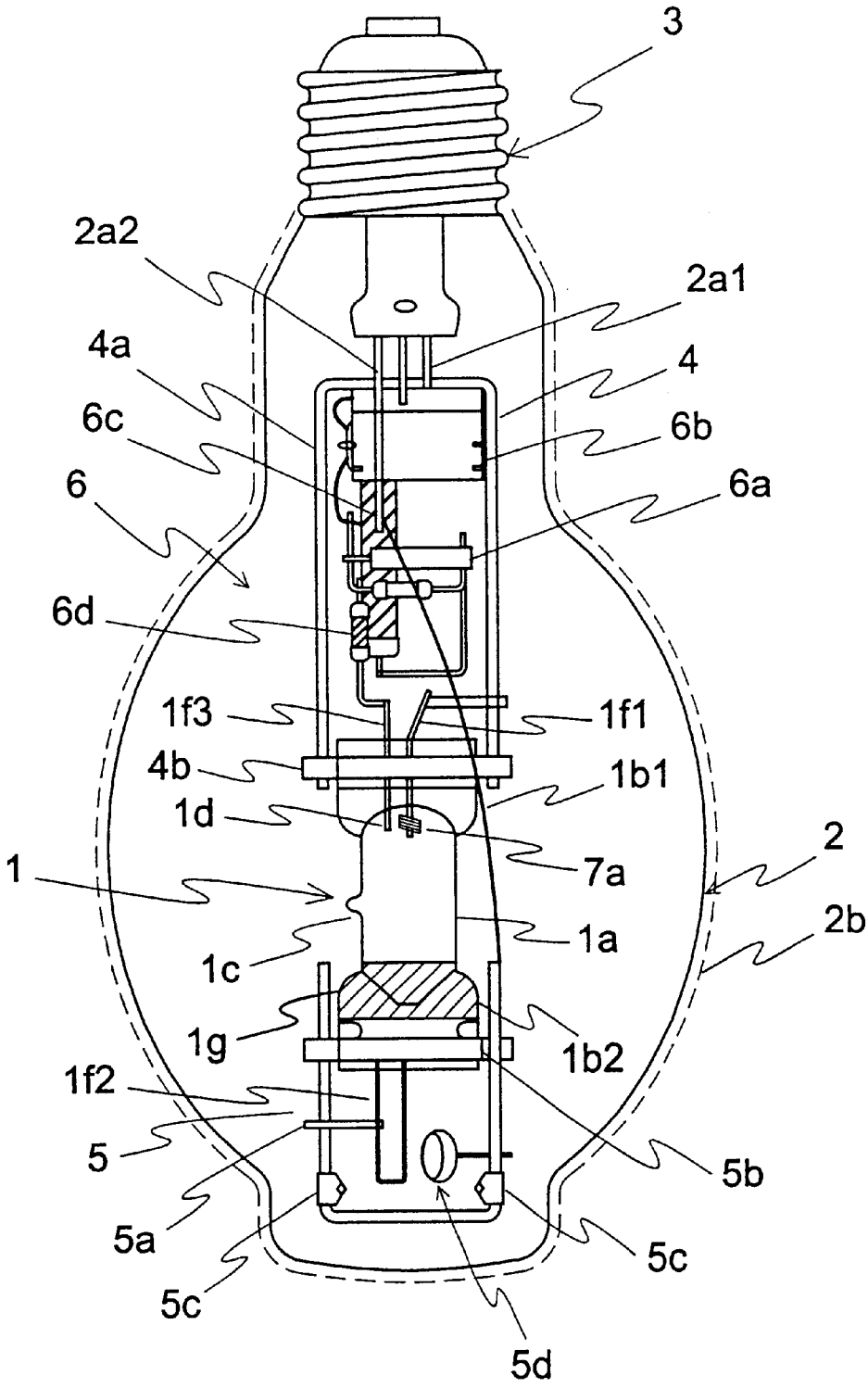
FIG. 1 is a front view of a high-pressure metal halide discharge lamp according to an embodiment of the present invention.

FIG. 1 shows a high-pressure metal halide discharge lamp provided with a discharge vessel 1, an igniter 6 to start the lamp, an upper supporting element 4 to support the igniter, and a lower supporting element 5 to be supported by an outer bulb 2 with a lamp cap 3.

Figure 2:
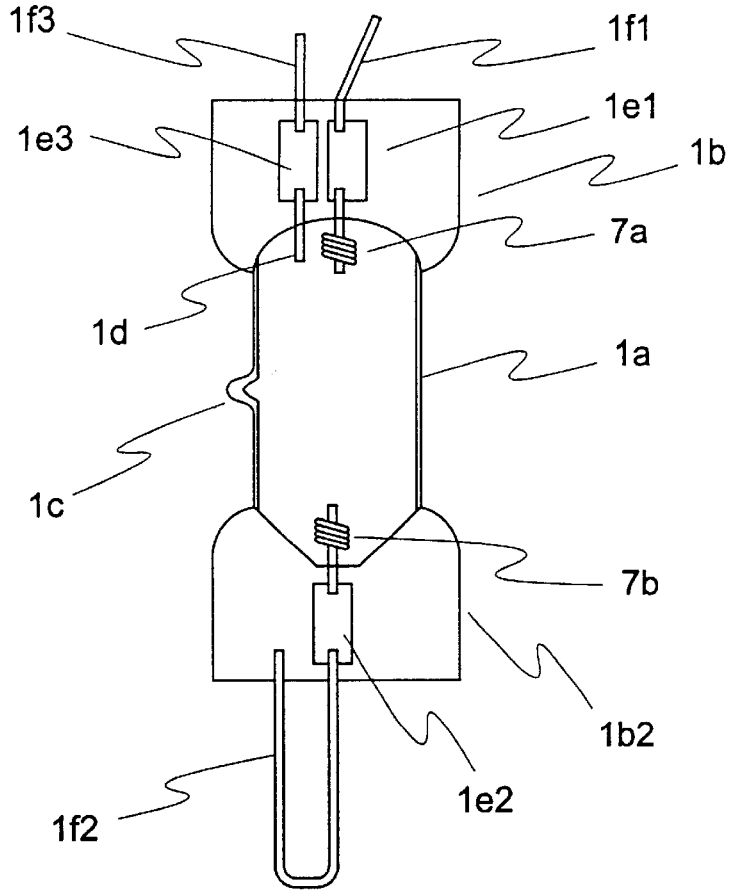
FIG. 2 is an enlarged view of a discharge vessel of a high-pressure metal halide discharge lamp shown in FIG. 1.

The discharge vessel 1 made of a quartz glass 1*a*, shown in more detail in FIG. 2, encloses a discharge space containing an ionizable filling, which comprises Hg, a rare gas, and a metal halide. The metal halides may be bromide or iodide, which contains rare earth elements, e.g., scandium or alkaline metals, e.g., sodium. The rare gas may be neon, argon, or xenon. The discharge vessel 1 is closed at two sealing portions 1*b*1, 1*b*2 and the sealing portion 1*b*2 has a heat-insulating layer.

A first electrode 7*b* and a second electrode 7*a* have tips with an interspersing arranged in the discharge space. The electrodes 7*a*, 7*b* are respectively connected to conductive wires 1*f*1, 1*f*2 having a molybdenum foil 1*e*1, 1*e*2 embedded in the sealing portions 1*b*1, 1*b*2.

The discharge vessel 1 further has an exhausting portion 1*c*. An auxiliary electrode 1*d* in the discharge vessel 1 located near the second electrode 7*a*. The auxiliary electrode 1*d* is also connected to a conductive wire 1*f*3 having a molybdenum foil 1*e*3 embedded in the sealing portion 1*b*1.

The discharge vessel 1 may consist of ceramic, e.g., monocrystalline or polycrystalline alumina, or of high silica, e.g., quartz glass.

The igniter 6 is provided with a switch, like a bimetal switch, a starter and a resistor to heat up the switch. The igniter 6 operated with a ballast (not shown) lets the lamp start with high voltage. When the igniter 6 operates, the auxiliary electrode 1*d* helps to start the lamp.

The upper supporting element 4 comprises a metal band 4*b,* that fastens the sealing portion 1*b*1 of the discharge vessel 1, and a U-shaped current conductor 4*a*. The conductor 4*a* mechanically supports the band 4*b* and the igniter 6. The conductive wire 1*f*1 is connected via the conductor 4*a* and a conductive wire 2*a*1 to the lamp cap 3. Another auxiliary conductive wire 1*f*3 is connected to the igniter 6.

The lower supporting element 5 comprises a metal band 5*b,* which fastens the sealing portion 1*b*2 of the discharge vessel 1 and a U-shaped current conductor 5*a*. The conductor 5*a* mechanically supports the band 5*b*. The lower supporting element 5 further comprises a spring member 5*c,* which is fixed to the discharge vessel 1 at an inner surface of the outer bulb 2, and a getter 5*d* to absorb an impurity gas in the outer bulb 2. The conductive wire 1*f*2 is connected via the conductor 5*a* and a conductive wire 2*a*2 to the lamp cap 3.

The discharge vessel 1, the igniter 6, and the upper and lower supporting elements 4, 5 are surrounded by the outer bulb 2 filled with an inert gas, e.g., nitrogen. Also the bulb 2 is covered with fluorine-containing polymer, so as not to scattered if it breaks.

Figure 3:
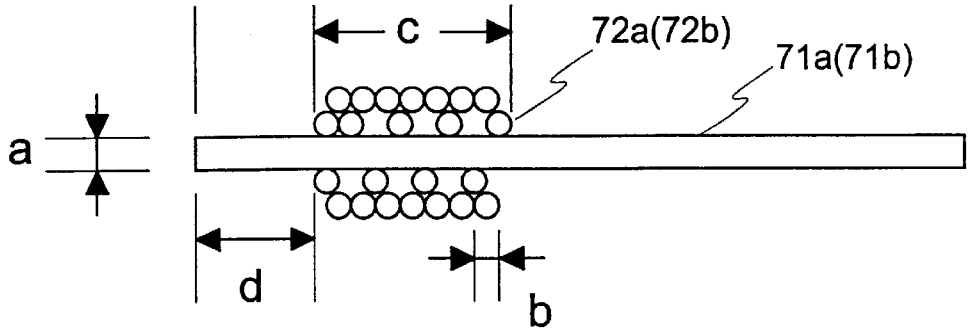
FIG. 3 is an enlarged cross sectional view of an electrode of a high-pressure metal halide discharge lamp shown in FIG. 1.

The first electrode 7*b* and the second electrode 7*a,* shown in more detail in FIG. 3, have electrode rods 71*a,* 71*b* and coils 72*a,* 72*b*.

The second electrode 7*a* without an emitter is disposed at an upper side in the discharge space during the lamp operation. The second electrode 7*a* is made of a metal having a high melting point. In this embodiment, the electrode rod 71*a* of the second electrode 7*a* and the coils 72*a,* 72*b* are made of doped-tungsten. The second electrode 7*a* may also be made of tungsten or rhenium.

Because the doped-tungsten comprises at least one metal selected from a group of aluminum, silicon, potassium, or other suitable things, a re-crystallization temperature becomes higher. Therefore, the size of tungsten particles become larger, and the doped-tungsten becomes harder. Consequently, if the temperature of the second electrode 7*a* becomes higher, the electrode 7*a* reduces its evaporation and thus prevents the blackening of the discharge vessel 1.

The first electrode 7*b* is disposed at a lower side in the discharge space. The first electrode 7*b* is also made of a metal having a high melting point and has an emitter. The first electrode 7*b* may be made of tungsten or rhenium. It is suitable for electrode 7*b* to contain between 0.3 and 5% by weight of emitter material.

The electrode rod 7*b*1 of the first electrode 7*b* is made of tungsten containing 1.7% by weight of thorium oxide. Accordingly, an electron emission characteristic of the first electrode 7*b* is better than the second electrode 7*a*. Therefore, even though the temperature of the lower electrode 7*b* of the lamp is moderate in the discharge vessel in comparison with the upper side therein, thermionic electrons from the first electrode 7*b* emit constantly.
Consequently, the lamp does not extinguish.

In order to reduce evaporation, a mass of the second electrode 7*a* having a coil 72*a* is greater than the mass of the first electrode 7*b,* so that the thermal conductivity of said second electrode 7*a* is higher. Accordingly, as the heat of the electrode rod 71*a* conducts to the coil 72*a,* the temperature of the second electrode 7*a* drops. The second electrode 7*a* further enables a reduction of evaporation.

Moreover, the thermal conductivity of the sealing portion embedding the second electrode 7*a* is higher than that of the sealing portion of the first electrode 7*b*. For example, the discharge vessel has an arc-shaped sealing portion at the upper side and a V-shaped sealing portion at the lower side. As the heat of the electrode rod 71*a* easily conducts to the arc-shaped sealing portion, which area is larger than the V-shaped sealing, the temperature of the second electrode 7*a* relatively drops. On the other hand, the heat of the electrode rod 71*b* does not conduct easily to the V-shaped sealing portion, so that the temperature of the first electrode 7*b* avoids dropping.

In accordance, as the temperature of the lower electrode 7*b* of the lamp is properly maintained in the discharge vessel 1, thermionic electrons from the first electrode 7*b* emit constantly. Consequently, the lamp does not extinguish.

The coils 72*a,* 72*b* further comprise an emitter to easily start the lamp. The emitter may be at least of one oxide selected from a group of thorium, cerium, and lanthanum.

In the present embodiment, the preferred dimensions of the first electrode 7*b* and the second electrode 7*a* are listed in Examples 1 to 3.

EXAMPLE 1

The dimensions of the first and second electrodes 7*a,* 7*b* are the same.

Diameter (a) of the electrode rods 71*a,* 71*b* - - - 0.6 mm

Wire Diameter (b) of the coils 72*a,* 72*b* - - - 0.4 mm

Length (c) of the coils 72*a,* 72*b* - - - 3.2 mm

Distance (d) the tip of the electrode rods 71*a,* 71*b* and the coils 72*a,* 72*b*- - - 2.0 mm

EXAMPLE 2

The second electrode 7*a*

Diameter (a) of the electrode rod 71*a* - - - 0.7 mm

Wire Diameter (b) of the coil 72*a* - - - 0.5 mm

Length (c) of the coil 72*a* - - - 4.0 mm

Distance (d) between the tip of the electrode rod 71*a* and the coil 72*a* - - - 2.0 mm The first electrode 7*b*

Diameter (a) of the electrode rod 71*b* - - - 0.6 mm

Wire Diameter (b) of the coil 72*b* - - - 0.4 mm

Length (c) of the coil 72*b* - - - 3.2 mm

Distance (d) between the tip of the electrode rod 71*b* and the coil 72*b* - - - 2.0 mm

EXAMPLE 3

The dimensions of Example 3 and 2 are the same except the distance (d) according to the second electrode 7*a*. The distance (d) between the tip of the electrode rod 71*a* and the coil 72*a* of the second electrode 7*a* is shorter than that of the first electrode 7*b* as follows. The coil 72*a* can conduct the heat of the tip of the electrode rod 71*a* to the coil 72*a* itself, because the distance (d) between the tip of the electrode rod 71*a* and the coil 72*a* is near.

The second electrode 7*a*

Diameter (a) of the electrode rod 71*a* - - - 0.7 mm

Wire Diameter (b) of the coil 72*a* - - - 0.5 mm

Length (c) of the coil 72*a* - - - 4.0 mm

Distance (d) between the tip of the electrode rod 71*a* and the coil 72*a* - - - 1.0 mm The first electrode 7*b*

Diameter (a) of the electrode rod 71*b* - - - 0.6 mm

Wire Diameter (b) of the coil 72*b* - - - 0.4 mm

Length (c) of the coil 72*b* - - - 3.2 mm

Figure 4:
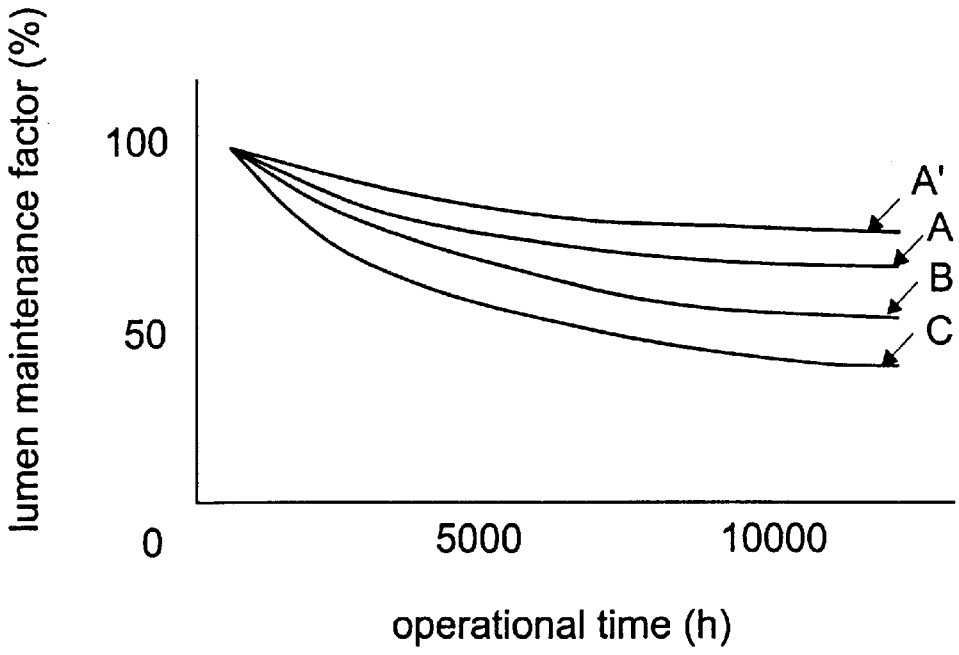
FIG. 4 is a graph showing a relationship between a lumen maintenance factor and an operational time of the lamp.

Distance (d) between the tip of the electrode rod 71*b* and the coil 72*b* - - - 2.0 mm FIG. 4 shows a relationship between a lumen maintenance factor and an operational time of the lamp. In FIG. 4, the lumen maintenance factor and the operational time of the lamp are respectively indicated in an ordinate and an abscissa.

The line A and A' respectively designates the lumen maintenance factor of Example 1 and 3. The line B designates the lumen maintenance factor of Example 2 and a Comparative Example 1. The line C designates the lumen maintenance factor of a Comparative Example 2.

In Comparative Example 1, the electrode rods 71*a,* 71*b* are made of tungsten containing thorium oxide. The coils 72*a,* 72*b* are made of doped-tungsten. The dimensions of the first electrode 7*b* and the second electrode 7*a* are the same as in Example 1.

It is seen that the lamp of the present Example 1 and 3 reduces the lumen maintenance factor (indicated by the line A and A') in comparison with that of the line B and C. In Example 2, the lumen maintenance factor of the lamp is even better.

As a mass of the second electrode 7*a* is greater than that of the first electrode 7*b,* the heat capacity of the second electrode 7*a* is greater. Therefore, the temperature of the second electrode 7*a* does not rise high and the evaporating ratio of the electrode 7*a* becomes lower. Consequently, the quartz glass of the discharge vessel 1 is able to avoid the blackening, so that it is kept clear.

Figure 5:
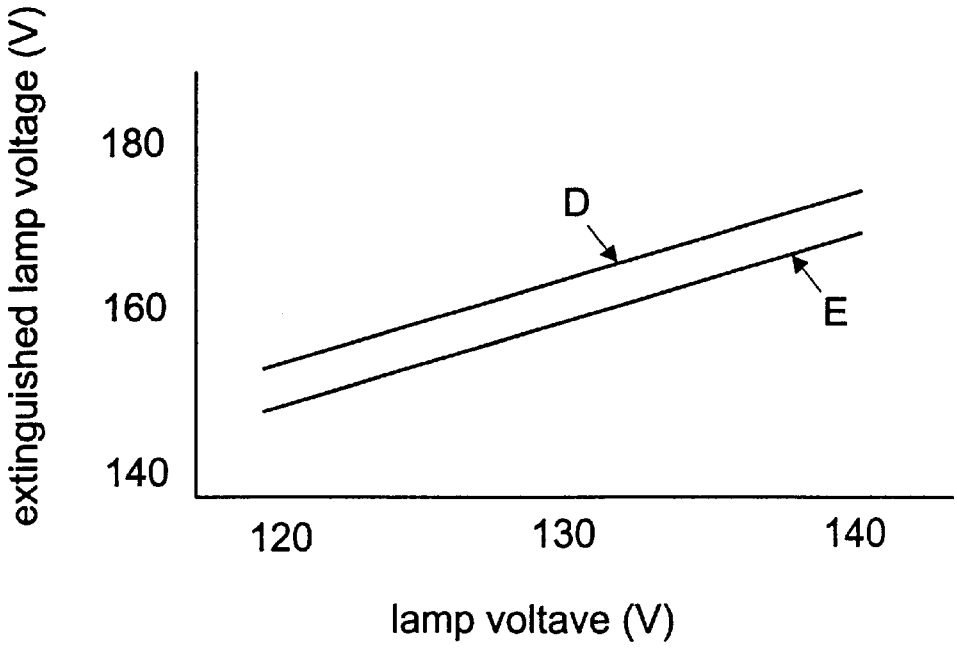
FIG. 5 is a graph showing the relationship between an extinguished lamp voltage and a lamp voltage.

FIG. 5 shows the relationship between an extinguished lamp voltage and a lamp voltage. In a rated lamp operating condition, the extinguished lamp voltage equals a supply voltage, which turn off the lamp, when the supply voltage is dropped to every six volts per second. If the extinguished lamp voltage becomes higher, the lamp occasionally tends to extinguish, even if the supply voltage is set at a suitable level for the lamp.

In FIG. 5, the extinguished lamp voltage and the lamp voltage are respectively indicated in an ordinate and an abscissa at the beginning of the test of measuring lamp life. The line D designates the extinguished lamp voltage of Example 1, Example 2 and Comparative Example 1. The line E designates the extinguished lamp voltage of Comparative Example 2. The dimensions of the embodiment 1 and that of Comparative Example 2 are the same.

In Comparative Example 2, the electrode rods 71*a,* 71*b* of the first and second electrodes 7*a,* 7*b* and the coils 72*a,* 72*b* are made of doped-tungsten. It is seen that the lamp of the present Example 1 reduces the extinguished lamp voltage in comparison with that of Comparative Example 2. By reducing the extinguished lamp voltage at the beginning of lamp life, the lamp avoids unexpectedly turn off by means of rising the lamp voltage at the rated operating conditions.

In accordance with the further embodiment of present invention, a lighting apparatus includes a high-pressure metal halide discharge lamp described above, a luminarie housing having a ballast and a socket connected to the discharge lamp cap. A lighting apparatus may be useful as a light fixture, a display lighting device, or a photochemical reaction device. As the lighting apparatus includes the lamp described above, the lighting apparatus would have a long life.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. A high-pressure metal halide discharge lamp for use in an upright mounted position, comprising:

a sealed light-transmitting discharge vessel having first and second seals and enveloping a discharge space that holds a gas comprising a rare gas and metal halides;

a first electrode comprising a first material and sitting at a lower side in the discharge space;

a second electrode comprising a second material and sitting at an upper side in the discharge space, wherein the first material emits electrons at a higher rate than that of the second material; and first and second conductive wires each connected to one of the electrodes, located in the first and second seals, and extending from the discharge vessel, the high-pressure metal halide discharge lamp being constructed and arranged to receive and be powered by an alternating current power.

2. A high-pressure metal halide discharge lamp according to claim 1, wherein said first electrode has an electrode rod with an emitter made of a metal having a high melting point, and a coil made of a metal having a high melting point; and wherein said second electrode has an electrode rod without an emitter made of a metal having a high melting point, and a coil.

3. A high-pressure metal halide discharge lamp according to claim 2, wherein said electrode rod of the second electrode is made of doped-tungsten; and wherein said electrode rod of the first electrode is made of tungsten containing thorium oxide.

4. A high-pressure metal halide discharge lamp according to claim 2, wherein the diameter of said electrode rod of the second electrode is greater than that of said first electrode.

5. A high-pressure metal halide discharge lamp according to claim 1, wherein thermal conductivity of said second electrode is higher than that of said first electrode.

6. A high-pressure metal halide discharge lamp according to claim 1, wherein the first seal embeds the first seal, wherein the second seal embeds the second electrode, and wherein the thermal conductivity of the second seal is higher than that of said first seal.

7. A lighting apparatus, comprising:

a high-pressure metal halide discharge lamp for use in an upright mounted position, comprising:

a sealed light-transmitting discharge vessel having first and second seals and enveloping a discharge space that holds a gas comprising a rare gas and metal halides, a first electrode comprising a first material and sitting at a lower side in the discharge space, a second electrode comprising a second material and sitting at an upper side in the discharge space, wherein the first material emits electrons at a higher rate than the second material, and first and second conductive wires each connected to one of the electrodes, located in the first and second seals, and extending from the discharge vessel, and an outer bulb having a lamp cap and surrounding said discharge vessel; and a luminarie housing having a ballast and a socket connected to said lamp cap, the high-pressure metal halide discharge lamp being constructed and arranged to receive and be powered by an alternating current power.

* * * * *